United States Patent [19]

Stavin

[11] 4,067,493

[45] Jan. 10, 1978

[54] CARTON HANDLE AND TOP RETAINER

[75] Inventor: Irwin A. Stavin, Long Beach, N.Y.

[73] Assignee: A & G Manufacturers, Inc., New York, N.Y.

[21] Appl. No.: 718,716

[22] Filed: Aug. 30, 1976

[51] Int. Cl.[2] ..... B65D 25/22; B65D 5/46

[52] U.S. Cl. ..... 229/52 AC; 229/46; 206/8; 24/143 B

[58] Field of Search ..... 229/52 A, 52 AC, 52 AL, 229/52 AM, 52 AW, 46; 16/125, 126; 24/16 R, 72.7, 143 B

[56] References Cited

U.S. PATENT DOCUMENTS

| | | | |
|---|---|---|---|
| 1,117,298 | 11/1914 | Zaar et al. | 229/46 |
| 1,690,850 | 11/1928 | Behrman | 24/143.4 |
| 1,747,980 | 2/1930 | Kondole | 229/52 AC UX |
| 2,374,160 | 4/1945 | Marienthal | 206/8 |
| 2,922,566 | 1/1960 | Wright | 229/52 AC X |
| 3,417,910 | 12/1968 | Johnson | 229/42 AC X |
| 3,636,594 | 1/1972 | Faivre | 229/52 AL |

FOREIGN PATENT DOCUMENTS

| | | | |
|---|---|---|---|
| 15,252 of | 1891 | United Kingdom | 229/52 AC |

*Primary Examiner*—Davis T. Moorhead
*Attorney, Agent, or Firm*—Howard C. Miskin

[57] ABSTRACT

A box includes an open topped body and a removable cover, the body having a pair of opposite apertures in its peripheral wall directly below the cover skirt wall. A short elastic retainer and a long flexible cord bail have opposite pairs of ends thereof joined to respective anchoring elements which are insertable through and larger than the apertures and engage the peripheral wall inside face, the retainer being stretched and holding the cover in closed position and the bail extending above the retainer and functioning as a handle. Each anchoring element is a resilient T-shaped plastic member or a deformable metal channel, a part of which clinches the bail and retainer respective ends.

3 Claims, 3 Drawing Figures

FIG. 1
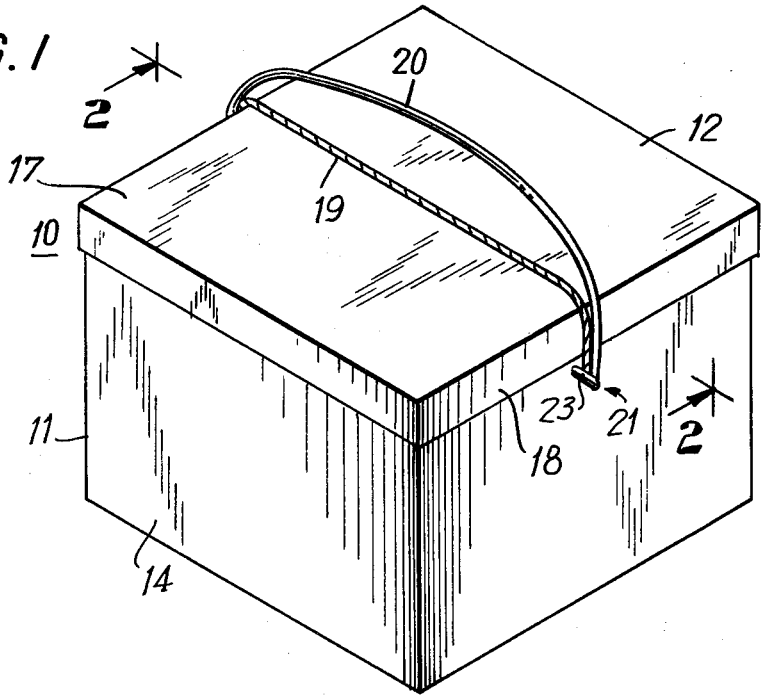
FIG. 2
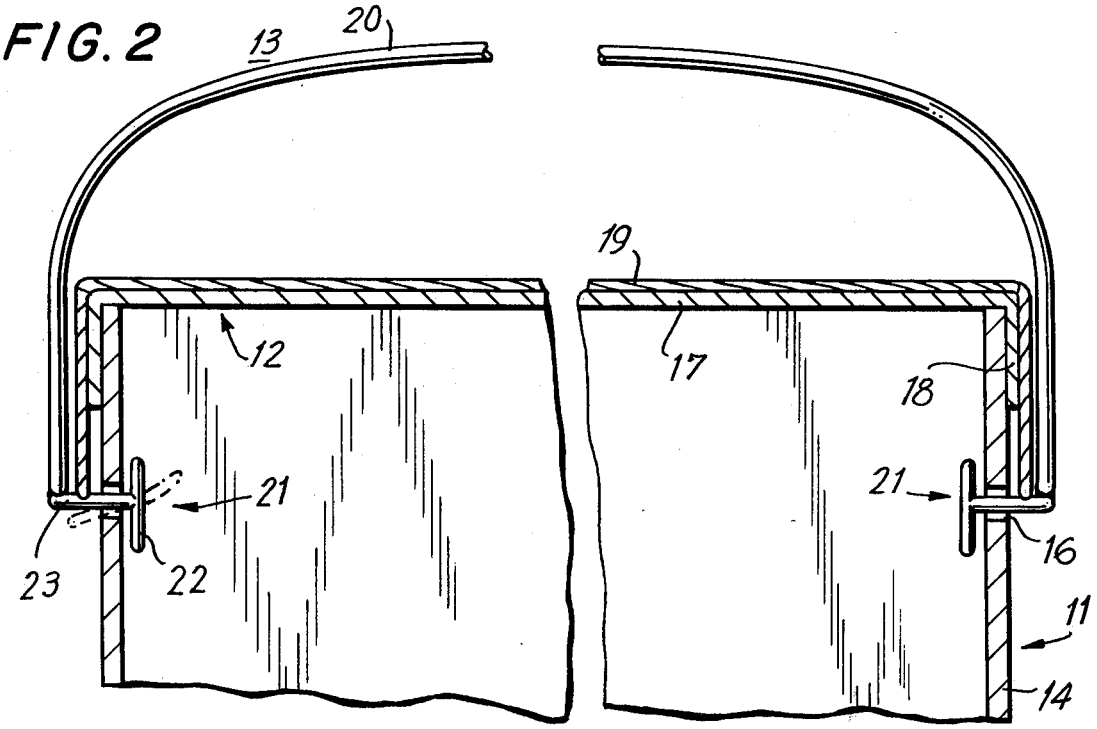
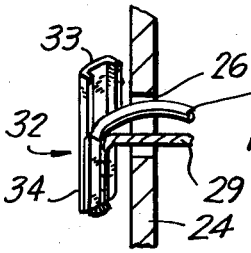
FIG. 3

CARTON HANDLE AND TOP RETAINER

BACKGROUND OF THE INVENTION

The present invention relates generally to improvements in receptacles and it relates more particularly to an improved hand carried box such as a gift box, shoe box or the like.

Many articles of apparel and other articles are commonly carried about in boxes which may be round or oval, such as gift boxes, or rectangular, such as shoe boxes. These boxes are generally open topped and provided with a lid or cover which commonly includes a top wall and a depending skirt wall. In use, it is necessary to releasably reliably retain the cover member in its receptacle closed position and it is also desirable to provide the body of the receptacle with a suitable handle or bail by which the box may be conveniently held. The structures and expedients heretofore employed in releasably locking the cover member in closed position and in affording a device by which the box may be held possess numerous drawbacks and disadvantages. They are expensive, bulky and awkward devices of little reliability, inconvenient to apply and use, of little versatility and adaptability, and otherwise leave much to be desired.

SUMMARY OF THE INVENTION

It is therefore a principal object of the present invention to provide an improved receptacle.

Another object of the present invention is to provide an improved hand carried box, such as a gift box, shoe box, or the like.

Still another object of the present invention is to provide an improved hand held gift, shoe box or the like provided with a conveniently applied releasable cover retainer and bail member.

A further object of the present invention is to provide a device of the above nature characterized by its reliability, ruggedness, low cost, simplicity, ease and convenience of use and great versatility and adaptability.

The above and other objects of the present invention will become apparent from a reading of the following description taken in conjunction with the accompanying drawing which illustrates preferred embodiments thereof.

In a sense, the present invention contemplates the provision of an improved hand carried receptacle device comprising an open topped receptacle including a peripheral wall having a pair of opposing apertures formed in the upper border thereof, a cover member overlying the receptacle top opening and a combined cover retainer and bail including a bail defining elongated flexible member, a retainer defining elastic member of normally lesser length than the bail member and a pair of anchoring elements, each provided with a terminal portion having at least one dimension greater than the width of the aperture and another dimension of lesser width to permit the transverse of the aperture by the anchoring element, the terminal portions being disposed along the inner face of the peripheral wall proximate the apertures opposite pair ends of the bail and retainer being connected to respective anchoring elements and the retainer engaging the cover member and the bail extending above the retainer.

In the preferred form, each anchoring element is of T-shape and formed of a resilient resin with the T-cross arm defining the terminal portion and one end of each retainer and bail being secured to the outer end of the upright leg. In a modified construction, the anchoring element is a deformable metal channel member with the ends of a retainer and bail nesting in one part of the channel whose legs are clinched about the retainer and bail ends.

The retainer and bail assembly is very simple and the anchor elements are easily and conveniently inserted through the preformed apertures and receive the bail and retainer to the receptacle. The complete assembly is reliable, convenient, and of great versatility and adaptability.

BRIEF DESCRIPTION OF THE DRAWINGS

FIG. 1 is a top perspective view of a receptacle embodying the present invention;

FIG. 2 is a fragmentary sectional view taken along line 2—2 in FIG. 1;

FIG. 3 is a front perspective view of a modified anchoring element shown inserted in a box wall and constituting another embodiment of the present invention.

DESCRIPTION OF THE PREFERRED EMBODIMENTS

Referring now to the drawing, particularly FIGS. 1 and 2 thereof, which illustrate a preferred embodiment of the present invention, the reference numeral 10 generally designates the improved hand carried box device which although illustrated of a square shaped box may be of any desired shape, for example a rectangular shoe box or the like. The box device 10 comprises an open topped receptacle main body 11, a cover member 12 and a retainer and bail assembly or device 13.

The receptacle body 11 and cover 12 are formed of cardboard and suitably covered and decorated in the known manner, the receptacle body 11 being of rectangular, square or oval cylindrical configuration including a bottom wall and an upright cylindrical peripheral wall 14. Formed in the upper border of peripheral wall 14 below the top edge thereof and at diametrically or axially opposite points are a pair of similarly shaped, aligned, preformed circular apertures 16. The cover member 12 includes a top wall 17 resting on the top edge of peripheral wall 14 and a depending peripheral skirt wall 18 which slidably engages the upper top face of peripheral wall 14 above the level of the apertures 16.

The retainer bail assembly 13 includes a relatively short elongated elastic cover retainer 19 and a relatively long elongated non-elastic bail defining member 20. The retainer 19 is formed of an elongated core formed of rubber, or other elastomer and is covered by a braided fibrous sheath of known construction. The bail 20 is advantageously formed of a multiple ply cord formed of natural or synthetic fiber.

The respective ends of the retainer 19 and the bail 20 are proximate each other and define corresponding pairs, and each retainer and bail end pair is secured to an anchoring element 21 which anchors the end pairs to the peripheral wall 14 at a respective aperture 16. Each anchoring element is T-shaped including a cross arm 22 and a perpendicular medial leg 23, and is integrally formed of resilient synthetic organic polymeric resin, for example, polypropylene, nylon, or the like. The width of the cross arm 22 is greater than the diameter of the aperture 16 and the combined thicknesses of arm 22 and leg 23 is less than the diameter of the aperture 16. The adjacent ends of retainer 19 and bail 20 are cemented, fused or otherwise firmly connected to the free end portions of corresponding anchoring element legs 23.

While a pre-formed circular aperture 16 has been illustrated, other entranceways such as crossed slits can be used, so that the anchoring element can be pushed through.

In attaching the assembly 13 to the receptacle body wall 14 each cross arm 22 is bent about the inner end of the corresponding leg 23 as shown by broken line in FIG. 2 to bring one half of the arm 22 along the leg 23 and the other half directed forwardly therefrom, and the so deflected arm is fully inserted through an aperture 16 and when it fully traverses the apertures it resiliently returns to its initial position preventing its withdrawal from the aperture, as shown by full line in FIG. 2.

In the assembled condition of the assembly 13, body 11 and cover 12, the retainer 19 extends between the opposite wall mounted anchoring elements 21, being inwardly of the bail 20, and is stretched and resiliently engages the top face of cover wall 17 to releasably tightly retain the cover 12 in its closed position. The bail member 20, being longer than the retainer 13, extends between the anchoring elements 21 above the retainer 19 and functions as a handle for holding the receptacle.

The embodiment of the present invention shown in FIG. 3 is similar to that first described except for the construction of the anchoring elements and the connection of the bail and retainer thereto. Specifically, the receptacle device includes a receptacle peripheral wall 24 having therein opposite anchoring apertures 26, an elastic retainer 29 and a longer bail member 30 which correspond in structure and relationship to the peripheral wall 14, apertures 16, retainer 29 and bail member 30 respectively of the first described embodiment.

Each pair of adjacent ends of the retainer 29 and bail 30 is attached to an anchoring element 32, which is of channel shape including a cross web 33 and side arms 34 and is formed of deformable metal. The adjacent ends of retainer 29 and bail 30 are folded and nested in one half of the channel shaped element 32 and the proximate portions of the channel side arms 34 are upset to tightly clinch and firmly engage the ends of retainer 29 and bail 30 which medially project from anchor element 32.

The anchor element 32 is of lesser maximum width than the width of aperture 26 so as to be insertable therethrough and is of a length greater than the width of aperture 26. In assembling the retainer 29 and bail 30 to the receptacle the anchoring elements 32 are merely oriented along the lengths of the retainer and bail and fully inserted through corresponding apertures 26 and are then permitted to turn to engage the inside face of peripheral wall 24 to thereby anchor the ends of the retainer 29 and bail 30 to the receptacle peripheral wall 24.

While there have been described and illustrated preferred embodiments of the present invention it is apparent that numerous alterations, omissions and additions may be made without departing from the spirit thereof.

I claim:

1. A hand carried receptacle device comprising an open topped receptacle including a peripheral wall having formed in the upper border thereof a pair of opposite apertures, a cover member overlying said open topped receptacle and a combined cover retainer and bail including a bail defining elongated flexible member, a retainer defining elastic member of normally lesser length than said ball member and a pair of anchoring elements, each provided with a terminal portion having at least one dimension greater than the width of said aperture and another dimension of lesser width whereby said terminal portion is insertable through an aperture, said terminal portions being disposed along the inner face of said peripheral wall proximate said apertures, opposite pairs of ends of said bail and retainer being connected to respective anchoring elements and said retainer engaging said cover member and said bail extending above said retainer, each of said anchoring element terminal portions comprising an elongated arm of a width less than the width of said apertures and of a length greater than said aperture width, each of said elongated arms includes an elongated deformable channel, a pair of ends of said retainer and bail registering with a fraction of the length of said channel, the side walls of said channel member fraction being secured to engage said bail and retainer ends, said channel member extending along the inside face of said peripheral wall and said bail and retainer extending therefrom through a respective aperture.

2. The device of claim 1 wherein each of said anchoring elements is of T-shape and is formed of a resilient flexible synthetic organic resin and includes a cross arm defining said terminal portion and a leg projecting outwardly through a respective aperture and secured to a respective pair of said bail and retainer ends.

3. The receptacle device of claim 1 wherein said retainer comprises a braid ensheathed elastic cord and said bail comprises a flexible inelastic cord.

* * * * *